US005476604A

United States Patent [19]

Nguyen

[11] Patent Number: 5,476,604

[45] Date of Patent: Dec. 19, 1995

[54] CHARGE INJECTION BARRIER FOR POSITIVE CHARGING ORGANIC PHOTOCONDUCTOR

[75] Inventor: Khe C. Nguyen, Milpitas, Calif.

[73] Assignee: Hewlett-Packard Company, Palo Alto, Calif.

[21] Appl. No.: 180,750

[22] Filed: Jan. 12, 1994

[51] Int. Cl.[6] ..... G03G 5/10

[52] U.S. Cl. ..... 252/62.3 Q; 252/62.3 T

[58] Field of Search ..... 252/62.3 Q, 62.3 T

[56] References Cited

U.S. PATENT DOCUMENTS 3,953,874 4/1976 Aviram et al. ..... 252/62.3 Q 4,923,774 5/1990 Van der Auweraer et al. ..... 252/500

4,988,597 1/1991 Spiewak et al. ..... 252/500

*Primary Examiner*—Helene Klemanski

[57] ABSTRACT

In organic photoconductors (OPC's) for electrophotography, a barrier layer is placed on top of the OPC. The barrier may have 2 layers—1, an electron withdrawing layer on top of the OPC; and,—2, an electron donating layer on top of the electron withdrawing layer. The barrier layer comprises: 1. a crosslinked polymer binder; 2. a charge injection prohibiter molecule, and optionally; 3. an electron withdrawing molecule. This formulation has resulted in a long-life OPC with more than 50,000 good cycles at high severity test conditions. The OPC had not only long life during continuous use, but also long shelf life and long on-again/off-again operation life.

21 Claims, 7 Drawing Sheets

CHARGE INJECTION BARRIER FOR POSITIVE CHARGING ORGANIC PHOTOCONDUCTOR

BACKGROUND OF THE INVENTION

1. Technical Field

This invention relates generally to photoconductors for electrophotography. The invention is a positive charging, organic photoconductor material with good speed and improved stability for liquid toner electrophotography. The improved stability is a result of a positive charge injection barrier layer on top of the organic photoconductor material.

2. Related Art

In electrophotography, a latent image is created on the surface of photoconducting material by selectively exposing areas of the charged surface to light. A difference in electrostatic charge density is created between the areas on the surface exposed and unexposed to light. The visible image is developed by electrostatic toners containing pigment components and thermoplastic components. The toners are selectively attracted to the photoconductor surface either exposed or unexposed to light, depending on the relative electrostatic charges of the photoconductor surface, development electrode and the toner. The photoconductor may be either positively or negatively charged, and the toner system similarly may contain negatively or positively charged particles. For laser printers, the preferred embodiment is that the photoconductor and toner have the same polarity, but different levels of charge.

A sheet of paper or intermediate transfer medium is then given an electrostatic charge opposite that of the toner and passed close to the photoconductor surface, pulling the toner from the photoconductor surface onto the paper or intermediate medium, still in the pattern of the image developed from the photoconductor surface. A set of fuser rollers fixes the toner to the paper, subsequent to direct transfer, or indirect transfer when using an intermediate transfer medium, producing the printed image.

The important photoconductor surface, therefore, has been the subject of much research and development in the electrophotography art. A large number of photoconductor materials have been disclosed as being suitable for the electrophotographic photoconductor surface. For example, inorganic compounds such as amorphous silicon (Si), arsenic selenite ($As_2Se_3$), cadmium sulfide (CdS), selenium (Se), titanium oxide ($TiO_2$) and zinc oxide (ZnO) function as photoconductors. However, these inorganic materials do not satisfy modern requirements in the electrophotography art of low production costs, high-speed response to laser diode or other light-emitting-diode (LED), and safety from non-toxicity.

Therefore, recent progress in the electrophotography art with the photoconductor surface has been made with organic materials as organic photoconductors (OPC's). Typically, the OPC's in the current market are of the dual-layer, negative-charging type with a thin charge generation material layer, usually less than about 1 micron (μm) thick, beneath a thicker charge transport material layer deposited on top of the charge generation layer. However, positive charging OPC's ((+)OPC's) are preferred for a discharged area developed (DAD) image as in laser printers.

Specific morphologies of phthalocyanine pigment (Pc) powder have been known to exhibit excellent photoconductivity. These phthalocyanine pigments have been used as a mixture in polymeric binder matrices in electrophotographic photoconductors, deposited on a conductive substrate.

The photoconductivity of the phthalocyanine pigment may be used to formulate the (+)OPC. Currently, known (+)OPC's may be classified as follows:

1. Single layer (+)OPC—Type I (see FIG. 1). The Pc is uniformly distributed throughout a relatively thick binder layer on a conductive substrate. Photons striking the upper surface of the layer generate positive and negative charges there. The generated negative charges neutralize positive charges established on the surface of the layer by the biasing corotron, discharging them. The generated positive charges travel through the bulk of the layer towards negative charges established by the biasing corotron at the conductive substrate.

In these Type I single-layer photoconductors, then, there is no need to add charge transport molecules, nor to have a separate charge transport layer. The phthalocyanine pigment content may be in the range of about 5–30 wt. %, high enough to perform both charge generation and charge transport functions, with the binder content being in the range of about 95–70 wt. %.

2. Single layer (+)OPC with charge transport molecule—TYPE II (see FIG. 2). Again, Pc in this OPC is uniformly distributed throughout a relatively thick binder layer on a conductive substrate. In addition, a charge transport molecule, called a sensitizer molecule, is also uniformly distributed throughout the binder layer. One example of a charge transport molecule is any one of the aryloamine group of compounds. In this OPC photons tend to penetrate more deeply into the binder layer, generating positive and negative charges there. The charge transport molecule assists in the movement of these generated charges towards their respective biases.

3. Multi layer (+)OPC with charge generation layer as the top layer—TYPE III (see FIG. 3). In this OPC there is a relatively thin top layer, called the charge generation layer (CGL), on top of a relatively thick layer called the charge transport layer (CTL). The CGL contains Pc pigment uniformly distributed throughout a binder. The CTL contains a hole transport molecule, also uniformly distributed throughout a binder.

In the TYPE III OPC, photons strike the upper surface of the thinner, top layer (CGL), generating positive and negative charges there. The generated negative charges neutralize positive charges established on the surface of the CGL, discharging them. The generated positive charges travel through the CGL, and through the thicker, bottom layer (CTL) towards negative charges established at the conductive substrate.

4. Multi layer (+)OPC with charge generation layer containing charge transport molecule as the top layer—TYPE IV (see FIG. 4). This OPC is constructed in the same way as the TYPE Ill OPC described above, except in the upper CGL there is an additional charge transport molecule, besides the Pc, also uniformly distributed throughout the binder.

5. Multi layer (+)OPC with charge generation layer as the bottom layer—TYPE V (see FIG. 5). This OPC is constructed in the same way as the TYPE III OPC described above, except the relative positions of the CGL and the CTL are reversed—in this OPC the thinner CGL is on the bottom, and the thicker CTL is on the top.

Other layers may be added to the OPC. To improve the transfer efficiency of the toner, for example, the top surface of the OPC may be overcoated with a low surface adhesion material. This type of overcoat layer is known as a release layer. See, for example, U.S. Pat. No. 4,923,775.

The charging characteristics of the photoconductor is the most important factor for high image quality in the conventional xerographic copiers or printers. Unfortunately, the charging characteristics of the photoconductor may be easily affected by electrical or chemical contamination, and/or by physical damage to the surface incurred during the printing process. The deterioration of the charging characteristics, thus, is frequently the cause of poor print quality. Many commercially available photoconductors experience deterioration of surface charging due to the effect of mechanical wear. However, the most common cause of charge instability in the positive charging photoconductor is not only mechanical wear or damage. Instead, the instability of the surface charge is exhibited as a decrease in charge acceptance along with an increase in dark decay electrical properties of the photoconductor after repeated cycles. Charge instability is also increased at operating temperatures above room temperature.

The mechanism of the charge instability in the (+)OPC, so far, is not well understood. It is expected that the surface of the (+)OPC is more chemically vulnerable to the operating conditions such as corona charging, ozone attack, humidity, heat, etc. Especially, this phenomenon is more prominent for the (+) OPC's classified as Types I, II, III and IV above mentioned. In these (+) OPC's configurations, the hole transport components such as pigment or hole transport molecules are directly exposed to the Corona during charging. It is suspected that these (+) OPC's (Types I, II, III and IV but not V) above are more likely to exhibit deteriorated charge characteristics due to surface charge injection into the bulk of the (+)OPC. This phenomenon is more critical in (+)OPC's than in some well known inorganic photoconductors, such as amorphous selenium, CdS, etc.

Therefore, the main object of this invention is to provide a charge injection barrier for the (+) OPC which exhibits stable electrical properties, including charge acceptance, dark decay and photodischarge, in a high cycle, high severity electrophotographic process. It is known to provide a charge injection preventing layer for (+) OPC's, such as a layer of SiO2 (silica) embedded in a polymer matrix. With such kind of heterogeneous phase, however it was found that it scatters the light from the exposure source and reduces the writing incident energy. Furthermore, a severe ghosting phenomenon is frequently observed using such kinds of heterogeneous barrier materials. The ghosting image phenomenon is associated with the light fatigue effect of the photoconductive device. This phenomenon generates the residual image from the previous imaging cycle into the new print. So, it is another objective of this invention to provide a charge injection preventing layer which does not cause the ghosting and the reduced contrast image.

Presently, the (+) OPC with the added release layer discussed above to enhance toner transfer efficiency is used only in single run applications. The incorporation of the release layer on the outer layer of the OPC does not appear to contribute to surface charge stability. In some cases, it is noticed that the release layer even adversely affects the OPC's charge stability. This adverse affect is believed to be the result of leakage of the catalyst used to cross-link the release layer into the bulk of the OPC. (See U.S. Pat. No. 4,923,775.)

Another goal of the present invention is to provide the solution of the organic coating barrier for the crosslinkable top coat including poly siloxanes and the other type of the crosslinking binders. In this case, the organic coating barrier is expected to stop the photoconductor poisoning from the leaking of the catalyst or the chemicals from the top coating of polysiloxanes.

Thus, the barrier layer for the surface of the (+)OPC in the present invention is basically comprised of selected molecules or moieties which are capable of prohibiting the injection of the unwanted positive charge from the surface of the photoconductor into the bulk of the photoconductor without stopping the migration of the negative charge from the photoconductor bulk toward the surface. Such kinds of highly functional chemical species must be embedded uniformly in a selected crosslinkable polymer matrix. The selected materials and process must not cause any optical perturbance to the photoresponse process of the photoconductor, and must be robust enough in the operating environment to withstand high humidity and high temperature.

DISCLOSURE OF THE INVENTION

To solve this OPC stability problem, a charge injection barrier layer is placed on top of the OPC. The barrier may have 2 layers—1, an electron withdrawing layer on top of the OPC;—2, an electron donating layer on top of the electron withdrawing layer. This formulation resulted in a long-life OPC with more than 50,000 good cycles at high severity test conditions.

The barrier layer comprises: 1. a crosslinked polymer binder; 2. a charge injection prohibiter molecule, and, optionally; 3. an electron withdrawing molecule.

The crosslinkable binder material for the barrier layer may be selected from a. Reactive hydroxy group containing polymers which exhibit:
   1. reactivities with —SiOH, —SiH, —Si(OR)3;
   2. self-crosslinking by thermal cure;
   3. reactivities with thermoset binders including melamine resin, poly diisocyanate, epoxy resin, phenolic resin, polyimide, alkyd resin, poly siloxanes, polyfluorosiloxanes, etc.; and
   4. reactivities with functional groups such as aldehydes, dialdehydes, poly-ols, alcohols, anhydrides, etc.

b. Reactive anhydride containing polymers such as styrene-maleic anhydrides; and c. Mixtures of (a) and (b) above.

The positive charge injection prohibiting (CIP) molecule is an electron donating molecule which has a functional group which forms hydrogen bonds with, for example, the lone pair of N atoms of the phthalocylanine pigment compounds. This way, the prohibitor molecule restricts the generation of free positive charge from the phthalocyanine pigment, especially under heat or electric field. These functional groups for the prohibitor molecule are —OH (hydroxy), —$NH_2$, —NH or —N<(amino).

Preferably, the barrier layer may also contain an electron acceptor and/or electron transporter molecule, known as an electron withdrawing molecule (EWM). These molecules have the —C=O (carbonyl), —Cl, —Br, —I, —F (halogen), —$NO_2$ (nitro), —CN (cyano), —OH (hydroxy), —$SO_2$ (sulfuryl/sulfonyl) or —COOH (carboxylic) functional groups.

From practicing this invention, one can produce an OPC with not only long life during continuous use, but also long shelf life and long on-again/off-again operation life.

BEST MODE FOR CARRYING OUT INVENTION

Figure 1:
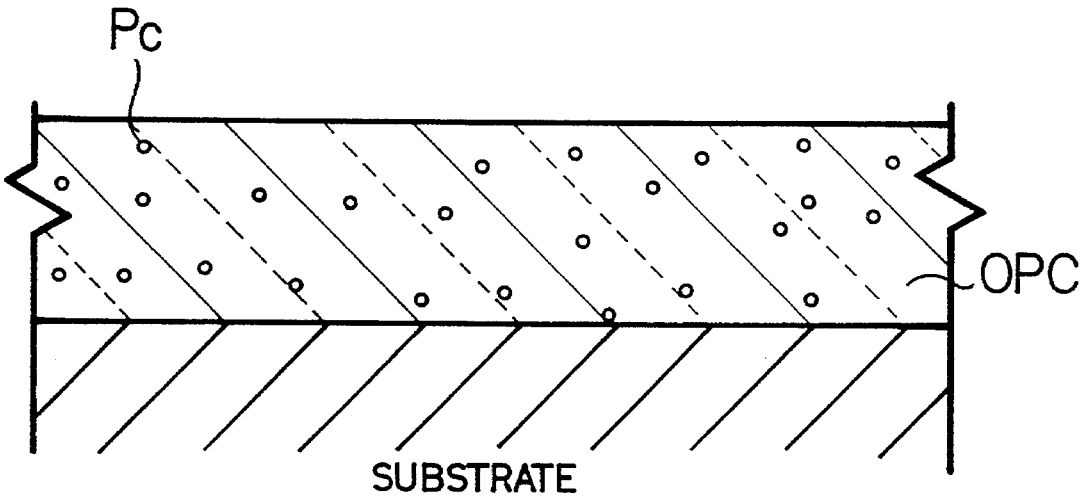
FIG. 1–5 are schematic, cross-sectional views of current OPC constructions.
Figure 2:
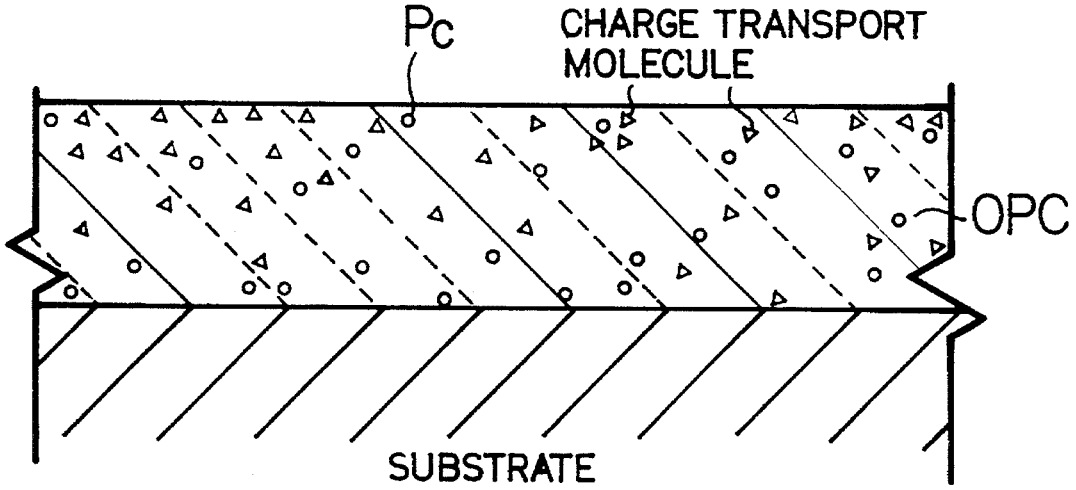
Figure 3:
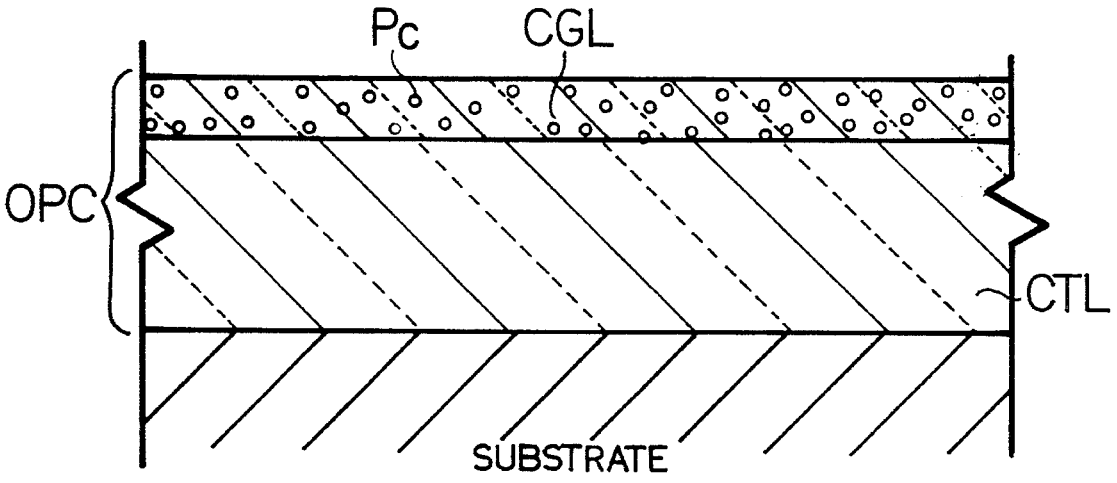
Figure 4:
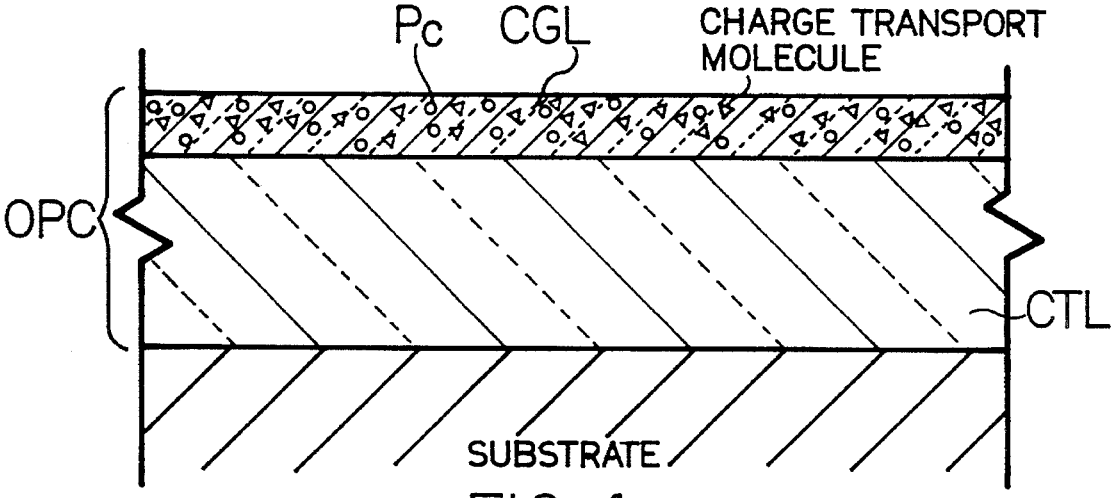
Figure 5:
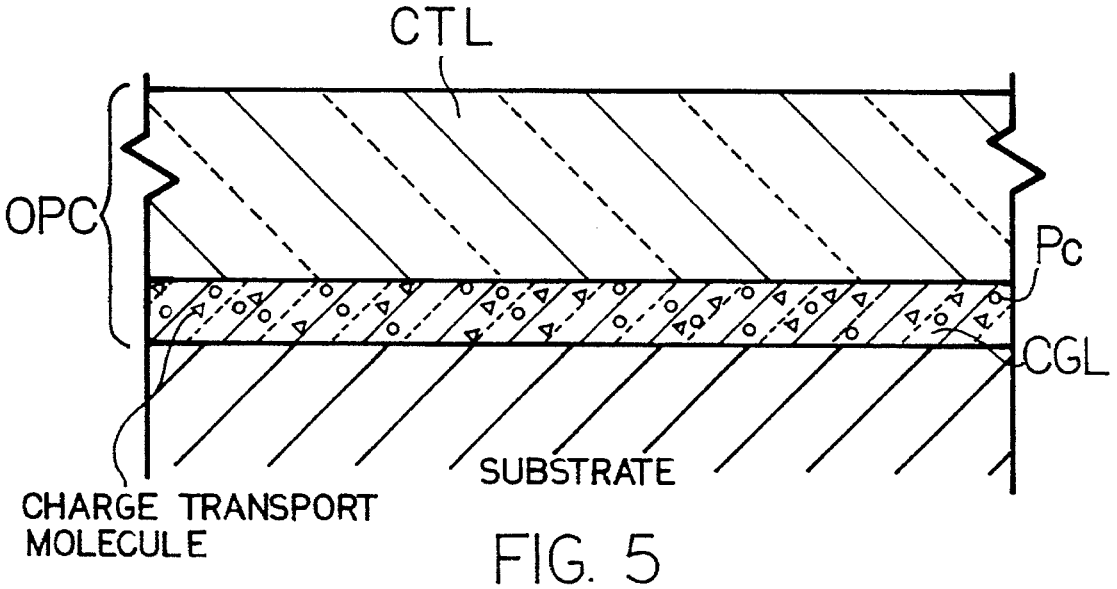
Figure 6:
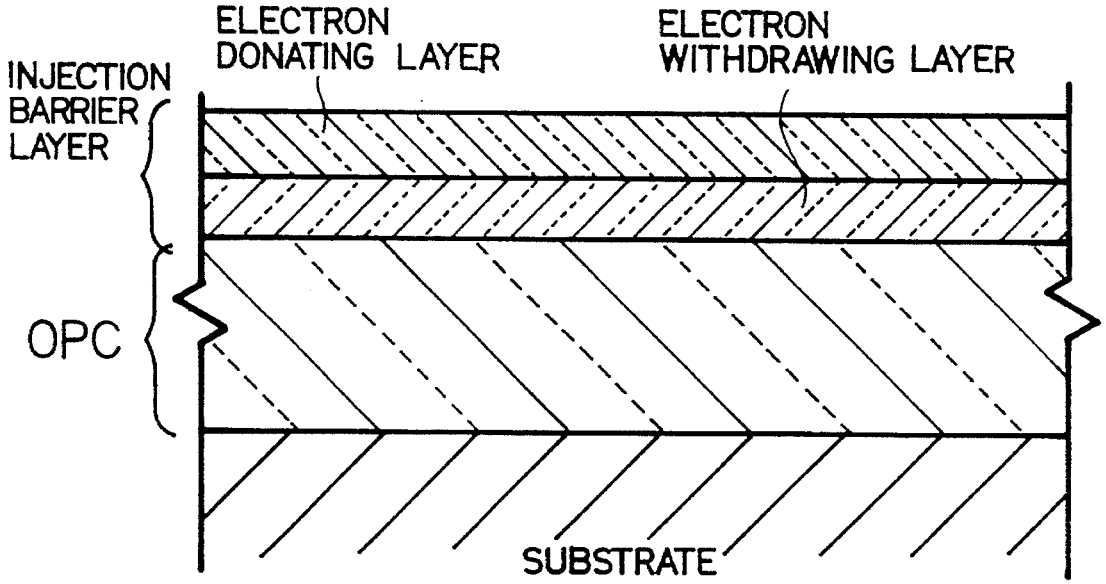
FIG. 6 and 7 are schematic, cross-sectional views of several embodiments of the invention.
Figure 7:
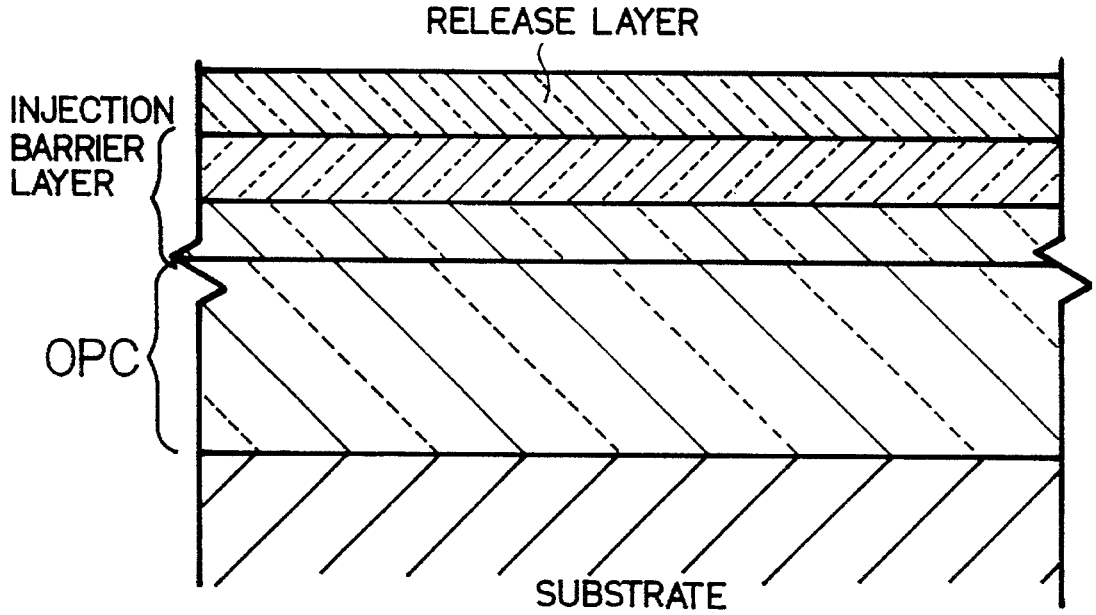

Referring to FIGS. 6 and 7, there are depicted several schematic, cross-sectional views of several embodiments of the invention. An OPC is provided with a conductive substrate, and a photoconductor layer on top of the substrate. A charge injection barrier layer is placed on top of the photoconductor layer. The charge injection barrier layer may contain a separate electron withdrawing layer on top of the OPC, and a separate electron donating layer on top of the electron withdrawing layer. Also, an optional release layer may be placed on top of the injection barrier layer. Also, other layers, not shown, which are commonly used in OPC's may be used, such as, for example, charge blocking layers, anti-curl layers, overcoating layers, and the like.

The conductive substrate and photoconductor layer on top of it may be made of conventional materials and assembled by conventional techniques.

In general, the cross-linkable polymeric binder for the charge injection barrier is selected from:

a. Reactive hydroxy group containing polymers which exhibit:
   1. reactivities with —SiOH, —SiH, —Si(OR)3;
   2. self-crosslinking by thermal cure;
   3. reactivities with thermoset binders including melamine resin, poly diisocyanate, epoxy resin, phenolic resin, polyimide, alkyd resin, poly siloxanes, polyfluorosiloxanes, etc.; and
   4. reactivities with functional groups such as aldehydes, dialdehydes, poly-ols, alcohols, anhydrides, etc.

For this invention, the binder resin of the charge injection barrier layer is preferably cross-linked polyvinyl alcohol (PVA) and its co-polymers.

Polyvinyl alcohol (PVA) has the following formula:

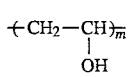

(1)

The co-polymer of PVA and polymethylmethacrylate has the following formula:

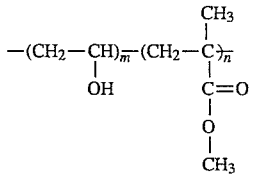

(2)

The co-polymer of PVA and polystyrene has the following formula:

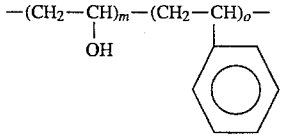

(3)

The co-polymer of PVA and fluoro polymer has the following formula:

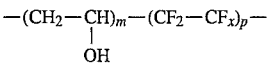

(4)

Polyvinyl butyral (PVB) has the following formula:

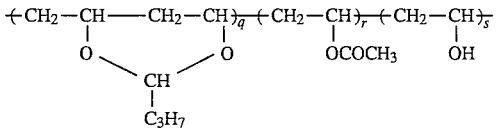

(5)

where q=50–95 mol % r=0.5–15 mol %, and s=5–35 mol %.

The PVA or PVB cross-linking may be effected simply by heating them to between about 150°–300° C. for about 2 hours. Other ways of crosslinking, for example, e-beam, UV or X-ray radiation, may also achieve results similar to those obtained with heat. The cross-linking reaction may be due to the —OH groups and the —O— groups from different locations on the same PVA or PVB polymer chain, or from different PVA or PVB chains, interacting to form bridge bonds.

Besides PVA or PVB, these crosslinkable polymers include phenolic resin and its copolymers, silanol terminated polysiloxanes and its derivatives, hydroxylated polystyrene and its derivatives, hydroxylated polyesters, hydroxylated polycarbonates, cellulose and its derivatives, for example, nitro cellulose, butyl cellulose and ethyl cellulose, and polyvinyl acetals, which have the following formula:

(6)

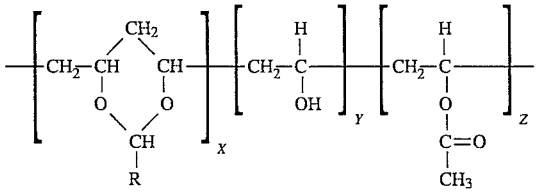

Where R=alkyl, alkoxy, amino groups, aminoalkyl, cyano —CN, halogen (Cl, Br, I, F), nitro —$NO_2$, hydroxy —OH, aryl and arylalkyl with substituent groups —$NO_2$, —CN, —OH, halogens, amino, heterocyclic groups, etc., b. Reactive anhydride containing polymers such as styrene-maleic anhydrides; and c. Mixtures of (a) and (b) above.

The crosslinking reaction of the above-mentioned polymers may be carried out, in general, by a thermal curing process, irradiation curing process, including e-beam cure, UV cure, or x-ray cure, and moisture cure. The crosslinking reaction may take place between portions of the polymer itself, called self-crosslinking, without adding any crosslinking aids. Or, a crosslinking aid may be added to accelerate the crosslinking reaction. These crosslinking aids are called crosslinkers. The desirable crosslinkers, in this case, may be selected from:

Alkoxy silanes having the general chemical structure $R_1$—$Si(OR_2)3$ (7), or $Si(OR_3)_4$ (8), where $R_1$, $R_2$, $R_3$=alkyl, allyl, aryl, with or without the conventional substituent groups;

Aldehydes, alcohols, carboxylic acid anhydrides; and

Thermoset binders as mentioned above.

A second crosslinking binder may be added to the above crosslinkable binders. These second binders are called co-crosslinkers, and may be selected from the conventional thermoset binders such as epoxy, melamine resin, unsaturated polyesters, polydiisocyanate, alkyd resin, polyimides, etc. Molecular weights for the binders may vary from about 20,000 to about 1,500,000.

Also, the positive charge injection barrier comprises a positive charge injection prohibiting (CIP) molecule. The positive charge injection prohibitor molecule is an electron donating molecule which has a functional group which forms hydrogen bonds with, for example, the lone pair of N atoms of the phthalocylanine pigment compounds. This way, the prohibitor molecule restricts the generation of free positive charge from the phthalocyanine pigment, especially under heat or electric field. These functional groups for the prohibitor molecule are —OH (hydroxy), —$NH_2$, —NH, or —N<(amino). I expect a similar mechanism to be operative with the other pigments besides the phthalocyanine ones.

Positive charge injection prohibiting compounds may be from the specific amino compounds of the general formulas:

$$NH_2—R_1—(NR_2)_n—R_3 \quad (9)$$

$$NH_2—A\ (NR_2)_n—R_3 \quad (10)$$

$$NH_2—R_1—(NHR_2)_n—Si(OR_5)_3 \quad (11)$$

$$NH_2—A—Si(OR_5)_3 \quad (12),$$

or from the specific hydroxy or mercapto compounds of the general formulas:

$$HO—R_1—COOR_2 \quad (13)$$

$$HS—R_1—COOR_2 \quad (14)$$

$$R_1—R_2(OH)_n—R_3 \quad (15)$$

$$R_1—R_2(SH)_n—R_3 \quad (16)$$

$$NH_2—R_1(OH)_m—(NR_2)_n—R_3 \quad (17)$$

$$NH_2—A(OH)_m—(NR_2)_n—R_3 \quad (18)$$

Where, for formulas 9–18 above:

$R_1$, $R_3$, $R_5$=alkyl, alkoxy, allyl, aryl, with and/or without the following substituent groups: —$NO_2$, —CN, —OH, —SH, —$SO_2$, —$SOCl_2$, —S, =C=O, —COOR, —CHO, —Cl, —Br, —I, —F;

$R_2$=hydrogen, alkyl, alkoxy, aryl with and/or without the following substituent groups —$NO_2$, —CN, —OH, —SH, —$SO_2$, —$SOCl_2$, =C=O, —CHO—COOR, —Cl, —Br, —I, —F;

A=hetrocyclic compounds selected from the following groups:

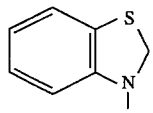
(19)

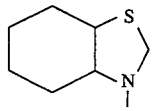
(20)

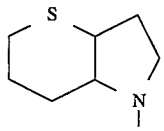
(21)

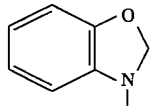
(22)

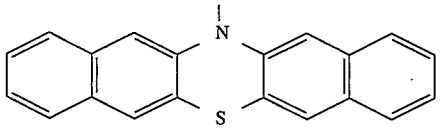
(23)

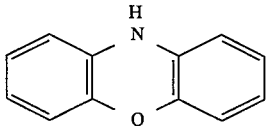
(24)

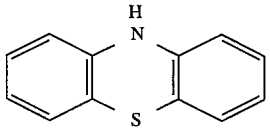
(25)

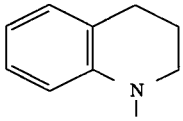
(26)

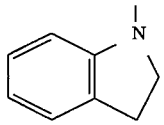
(27)

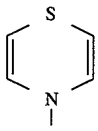
(28)

-continued (29)

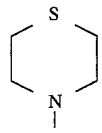

(30)

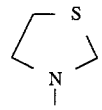

(31)

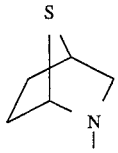

(32)

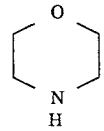

m,n=0,1,2 . . . 5.

For example, some CIP molecules may be:

1. Aminobenzimidazole
2. 4-Amino-1-benzylpiperidine
3. 1-Amino-2-(dimethyl amino) fluorene
4. 1-Amino-2,6-dimethylpiperidine
5. 2-Amino-4,6-dimethylpyridine
6. 3-Amino-5,6-dimethyl-1,2,4-diazine
7. 4-Amino-3,5-di-2-pyridyl-4H,-1,2,4-triazole
8. 3-Amino-9-ethylcarbazole
9. 2-(2-Amino ethyl)-1-methylpyrrole
10. 2-(2-Amino ethyl)-1-methylpyrrolidine
11. 1-(2-Amino ethyl) pyridine
12. 1-(2-Amino ethyl) piperazine
13. 1-(2-Amino ethyl) piperidine
14. 1-Amino-4-(2-Hydroxy ethyl) piperidine
15. 2-Amino-9-hydroxy fluorene
16. 3-Amino-5-hydroxy pyrazole
17. 2-Amino-3-hydroxy pyridine
18. 5-Amino iso quinoline
19. 4-Amino-2-mercapto pyrimidine
20. 2-Amino-5-mercapto-1,2,4-triazole
21. 6-Amino-5-nitroso-2-thiouracil
22. 3-Amino propyl triethoxy silane
23. 3-Amino propyl trimethoxy silane
24. (Cyclohexyl amino methyl) methyl diethoxy silane
25. (Cyclohexyl amino methyl) dimethylethoxy silane
26. N,N-Diethyl amino trimethyl silane 27. 2,2,4,4,6,6-Hexamethyl cyclo trisilazane (33)

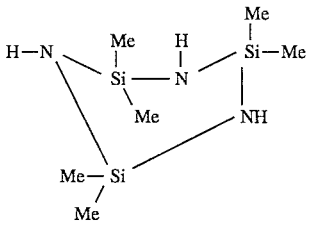

-continued

28. Octamethyl cyclo tetrasilazane (34)

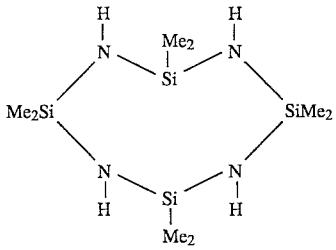

29. (R)-$N_1$-phenethyl-N'-triethoxy silyl propylurea (35)

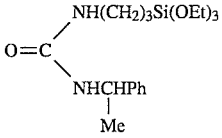

30. Tetrakis (dimethyl amino) silane (36)

$$(Me_2N)_4Si$$

31. 1,1,4,4-Tetramethyl-1,4-Bis (N,N-dimethyl amino) disilethylene (37)

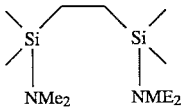

32. N-[3-(Triethoxy silyl) propyl]-4,5-dihydro imidazole (38)

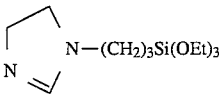

33. Trimethoxy silyl propyl diethylenetriamine (39)

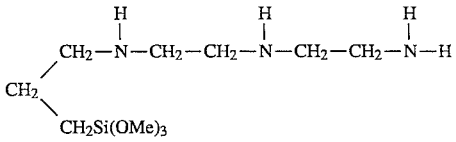

34. 1-Trimethyl silyl-1,2,4-triazole (40)

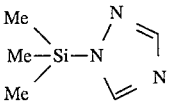

35. 1,3,5-Trimethyl-1,3,5-trivinyl cyclo trisilazane

36. Tris (cyclo hexyl amino) methyl silane (41)

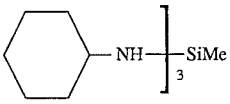

-continued

37. Tris (dimethyl amino) phenyl silane

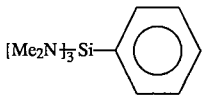

(42)

38. N,O-Bis (trimethyl silyl) hydroxylamine

39. N-(2-Amino ethyl)-3-amino propyl methyl dimethoxy silane

40. Diethyl (trimethyl silyl methyl) phosphonate 41. (Tinuvin® 328) 2-(2'-Hydroxy-3', 5'-di-tert-amyl phenyl) benzotriazole 42. (Tinuvin® 770) Bis(2,2,6,6-tetramethyl-4-piperidyl) sebacate 43. (Tinuvin® 144) Bis(1,2,2,6,6-pentamethyl-4-piperidinyl) (3,5-di-tert-butyl- 4-hydroxybenzyl) butyl propane dioate 44. (Tinuvin® 292) Bis(1,2,2,6,6-penta methyl-4-piperidinyl) sebacate 45. (Irganox® 259) 1,6-Hexamethylene bis (3,5,-di-tert-butyl-4-hydroxy) cinnamate 46. (Irganox® 1010) Tetrakis [methylene (3,5-di-tert-butyl-4-hydroxy hydro) cinnamate]methane 47. (Irganox® 1035) Thiodiethylene bis (3,5-di-tert-butyl-4-hydroxy hydro) cinnamate 48. (Irganox® 1076) Octadecyl 3,5-di-tert-butyl-4-hydroxy hydro cinnamate 49. AgeRite Resin D® powder Polymerized 1,2-dihydro-2,2,4-trimethyl quinoline Preferably, the positive charge injection barrier layer may also contain an electron acceptor and/or electron transporter molecule, known as an electron withdrawing molecule (EWM).

Examples of electron withdrawing molecules are:

1) phthalic anhydride
2) dinitrophenol
3) 2-methylanthraquinone
4) 2,7-dinitrofluorene
5) 2,7-dinitrofluorenone
6) (2R)-(+)-Glycidyl tosylate.

If the charge injection barrier layer itself has separate layers, the electron acceptor/transporter molecules (EWM) are predominantly in the sensitizing layer.

The ratio of electron acceptor molecule to electron donor molecule is between about 100/1–1/100. If the charge injection barrier layer is in one combined layer, the electron accepting and electron donating molecules may be combined into one bipolar molecule, for example, methyl hydantoin, di-nitro aniline, di-nitro-fluoro aniline, or di-nitro-biphenyl amine. When the charge injection prohibiting molecule and the electron withdrawing molecule are in the same molecule, the general chemical structure of the molecule is

A—R—D (43), where A represents the electron withdrawing part of the molecule, selected from the electron withdrawing functional groups: —$NO_2$—CN, =C=O, —SOx, X=1, 1.5, 2, 3, 3.5 and 4 —S, —OR; R=alkyl, allyl, aryl; and D represents the charge injection prohibiting part of the molecule.

Examples of A—R—D molecules are:

1) 2,3-Pyridinedicarboxylic anhydride
2) Dinitrofluoro aniline
3) 4,5-Dicyanoimidazole
4) 2,6-Dichloropurine
5) Maleimide
6) Methyl hydantoin
7) O-benzoic sulfimide
8) 2-(-4-Aminophenyl)-6-methylbenzothiazole
9) 2-Amino-5-(4-nitrophenylsulfonyl) thiazole
10) N, N-Dimethylindoaniline.

The optional overcoating release layer may comprise organic polymers such as polydimethylsiloxane (PDMS) and its derivatives, including fluoro alkyl substituted PDMS, silanol terminated PDMS, methyl hydrogen siloxane terminated PDMS, vinyl terminated PDMS, etc., or inorganic polymers that are electrically insulating or slightly semiconductive. This overcoating layer may range in thickness from about 0.1 μm to about 8 μm, and preferably from about 3 μm to about 6 μm. An optimum range of thickness is from about 3 μm to about 5 μm.

The process of making the barrier layer for this invention is defined by a uniform mixture of the required components: reactive hydroxy binder, charge injection prohibiter, optional crosslinker, optional second crosslinker (co-crosslinking binder), and optional electron withdrawing molecules into the appropriate solvent and then coating of the solution on the top of the photoconductor. The coating process may be done by a number of different procedures including dip coating, ring coating, spray coating, or hopper coating, etc.

The drying process for the barrier layer 3 is basically comprised of two steps: solvent eliminating step which may be carried out at room temperature or at the boiling point of the used solvent, and the crosslinking step which causes the crosslinking reaction of the crosslinkable binder. The crosslinking step may be done at different temperatures including lab ambient such as moisture cure, or at elevated temperature from 80° C.–200° C., such as thermal cure.

The thickness of the coating can be varied from 0.001 μm to 20 μm. The most desirable range of the thickness is between 0.01 μm to 5 μm.

This kind of the surface protection material for the photoconductor can be applied for any types of photoconductor which is comprised of photoconductive pigment embedded in a polymeric binder, including ZnO, CdS, phthalocyanine-binder or thin film photoconductor such as Se, amorphous Si, or multi layer OPC, especially, positive charging photoconductors.

The following EXAMPLES will clarify the uniqueness of the invention.

EXAMPLE 1

Preparation of the Photoconductor 16 g of x—$H_2$Pc, 84 g of polycarbonate (Mobay Chemical, Makrolon™), 900 g of dichloromethane, 2000 g of Zr beads, 3 mm diameter, were milled together in a ceramic container using a ball mill for 48 hrs. The blue suspension, after being separated from milling media, was applied with a doctor blade on an Al/Mylar™ substrate. The coating thickness was about 7 μm after being dried at 80° C. for 4 hrs.

EXAMPLE 2

| Preparation of the Barrier Layer | |
|---|---|
| Polyvinylbutyral (B98, Monsanto Chemical) | 65% wt. |
| Amino propyl triethoxysilane (Aldrich Chem.) | 25% wt. |

-continued

| Preparation of the Barrier Layer | |
|---|---|
| Phthalic anhydride | 10% wt. |

were dissolved in Isopropyl alcohol (IPA) to achieve 5 wt. % solids. The solution was coated on the surface of an OPC formulated in EXAMPLE 1, using a doctor blade in order to achieve a coating thickness of 1 μm. The coating layer was dried at the lab ambient for 1 hr. and then baked in an oven at 140° C. for another 1 hr.

EXAMPLE 3

| Preparation of the Top Coat | |
|---|---|
| Poly dimethyl siloxane (Syloff 23, Dow Corning) | 100 part |
| Catalyst 23A | 1 part |
| Heptane | 1900 part |

were dissolved together. The solution was coated on the top of an OPC formulated in EXAMPLE 1 using a doctor blade in order to achieve a thickness of 3 μm after being dried at 135° C. for 10 minutes.

EXAMPLE 4

Preparation of OPC having both the Barrier Layer and the Top Coat

The OPC bearing the protection layer of EXAMPLE 2 was overcoated with the solution described in EXAMPLE 3 and by the same procedure as Example 3 to form a tri-layer OPC comprised of OPC layer, barrier layer and the top coat.

All of these OPC samples were tested by being wrapped around a well grounded A1 drum of 180 mm diameter. The A1 drum was inserted into a laser printing test mechanism developed at Hewlett-Packard Co. For a life test, in each cycle, the OPC sample was exposed to a corona charger, then, a 780 nm laser scanned with polygon mirror to produce 2 mW output, and then to a LED eraser. The corona charger was set to a grid voltage of +600 V, and a corona current of 450 μA. The surface potential of the OPC is detected using an electrostatic charge probe (Trek Model 362) placed between the corona charger and the area of laser exposure. The drum rotation speed was set at 3 inches per second. In order to test the OPC performance at high temperature, a sheet heater was inserted inside of the drum, and the drum was monitored and controlled by a thermocouple placed closely to the surface of the photoconductor and connected to the heater.

Test 1. Dark Decay

The dark decay characteristics of the photoconductors were tested by measuring the surface potential decay during 2 minutes after stopping the corona power supply.

Test 2. Life Test

The life of the photoconductors were tested by measuring the surface potential at the beginning of each cycle (charging, laser exposing, LED erasing).

Results

Figure 8:
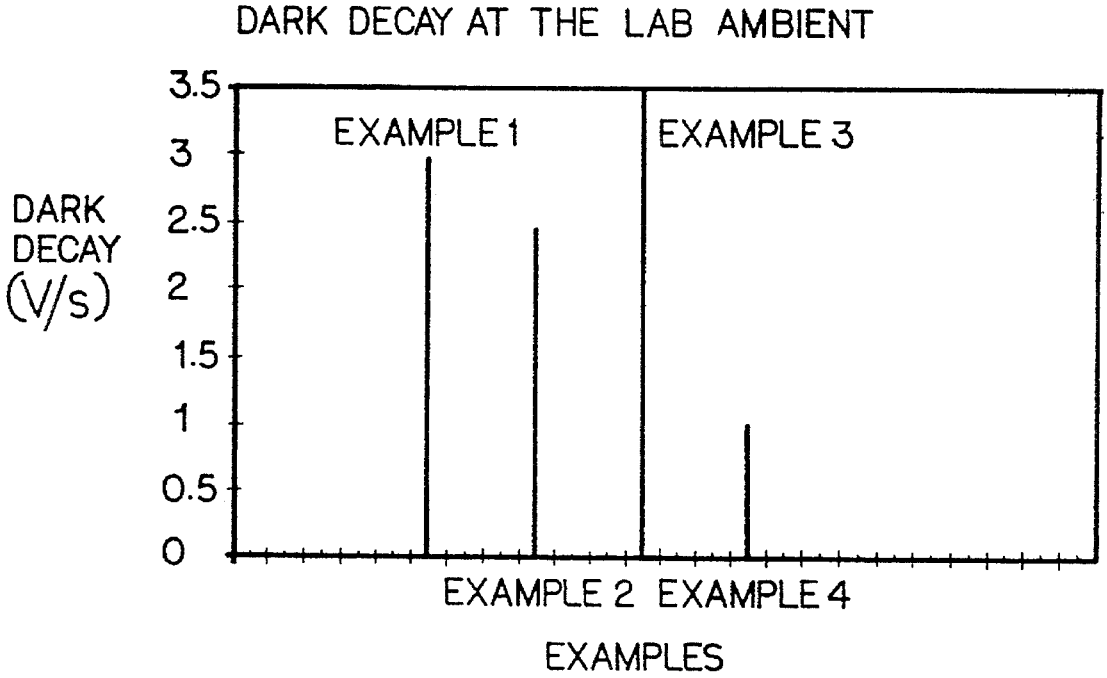
FIG. 8–14 are graphic results of the results of some of the worked Examples.

FIG. 8—dark decay at the lab ambient of each EXAMPLE 1, 2, 3, and 4.

Figure 9:
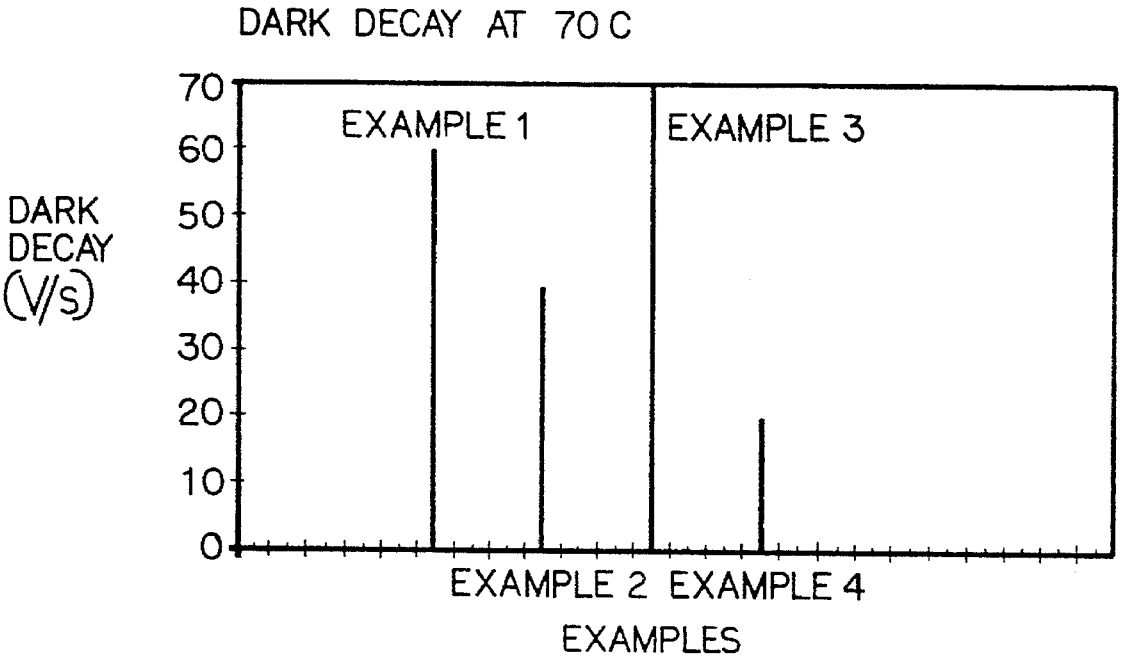

FIG. 9—dark decay at 70° C. of each EXAMPLE 1, 2, 3 and 4.

Figure 10:
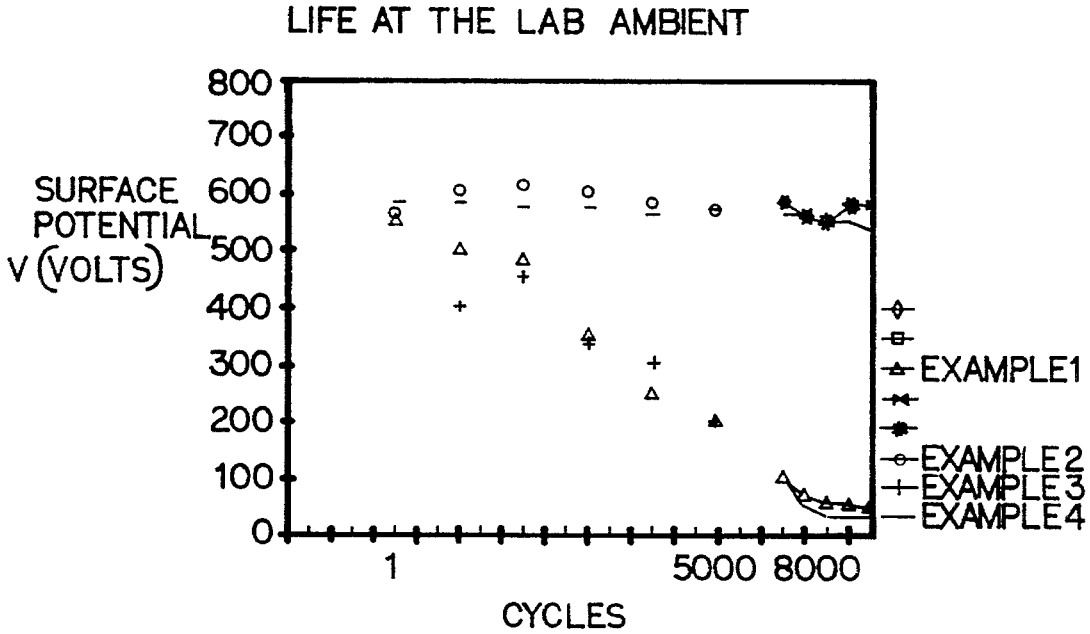

FIG. 10—10K cycle life at the lab ambient of each EXAMPLE 1, 2, 3 and 4.

Figure 11:
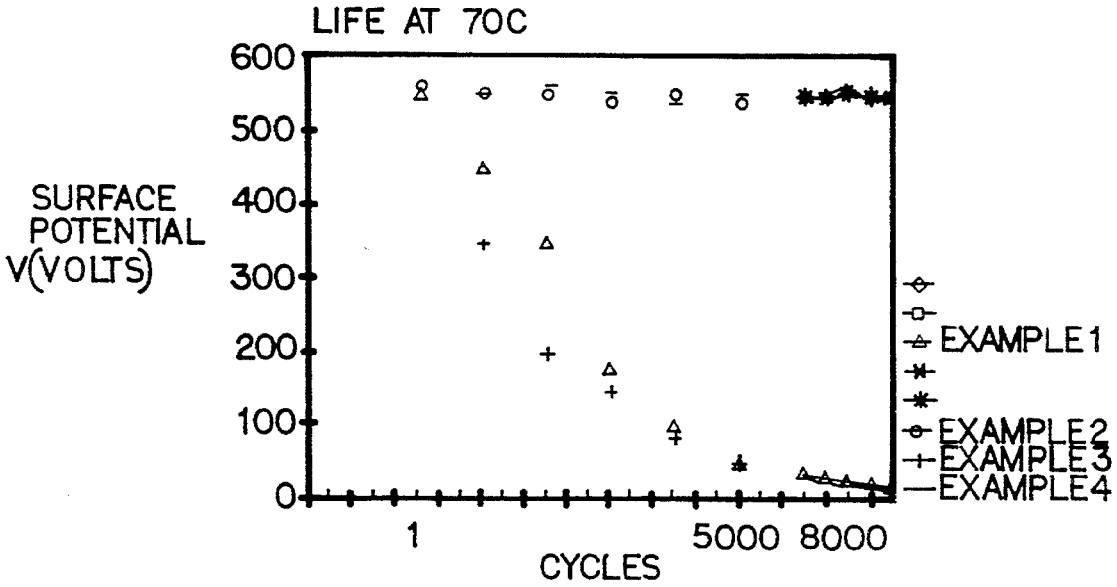

FIG. 11—10K cycle life at 70° C. of each EXAMPLE 1, 2, 3 and 4.

From FIG. 8 and FIG. 9, one can see that the significantly reduces the dark decay, especially at high temperature such as 70° C., revealing the effective prevention of surface charge injection.

From FIG. 10 and FIG. 11, it is also observed that the photoconductor life is significantly improved when the barrier layer was used for either case, with or without top coat of polysiloxanes. It should be noted that the top coat of polysiloxanes, for example, has been known as a protection layer coating in the prior art. However, in these experiments, I observed the surface charge deterioration in the photoconductor sample having the top coat of polysiloxanes. In this case, the instability of the surface charge (EXAMPLE 3) can be explained as the chemical poisoning of the photoconductive layer, and may be due to the leakage of the catalyst of the crosslinking reaction from the polysiloxanes coating into the bulk of the OPC. The improvement of the surface charge stability in EXAMPLE 4 reveals that the barrier coating of EXAMPLE 2 has effectively prevented the leakage of the catalyst from the top coat of polysiloxanes.

EXAMPLE 5

| Preparation of the electron withdrawing layer | |
|---|---|
| Poly vinyl butyral B98, Monsanto Chemical | 60 parts |
| Dinintrophenol (Electron Withdrawing Molecule (EWM)) | 20 parts |
| Pyridine dicarboxylic acid anhydride (crosslinker) | 20 parts |
| Isopropyl Alcohol (IPA) | 4000 parts |

The whole mixture was dissolved completely by stirring, and coated on the top of an OPC formulated as in EXAMPLE 1, using a doctor blade. The coating thickness was about 0.5 μm after being dried at 135° C. for 1 hr.

EXAMPLE 6

| Preparation of the charge injecting prohibiter layer | |
|---|---|
| Poly vinyl butyral (B98, Monsanto Chemical) | 1 part |
| Amino propyl alkoxy silane (Z6020, Dow Corning) | 20 part |
| Isopropyl alcohol (IPA) | 819 part |

The whole mixture was dissolved completely by stirring, and coated on the top of an OPC formulated as in EXAMPLE 5 using a doctor blade. The coating layer was dried in air for 30 minutes and at 80° C. for 20 minutes. The coating thickness was about 0.5 μm.

EXAMPLE 7

Figure 12:
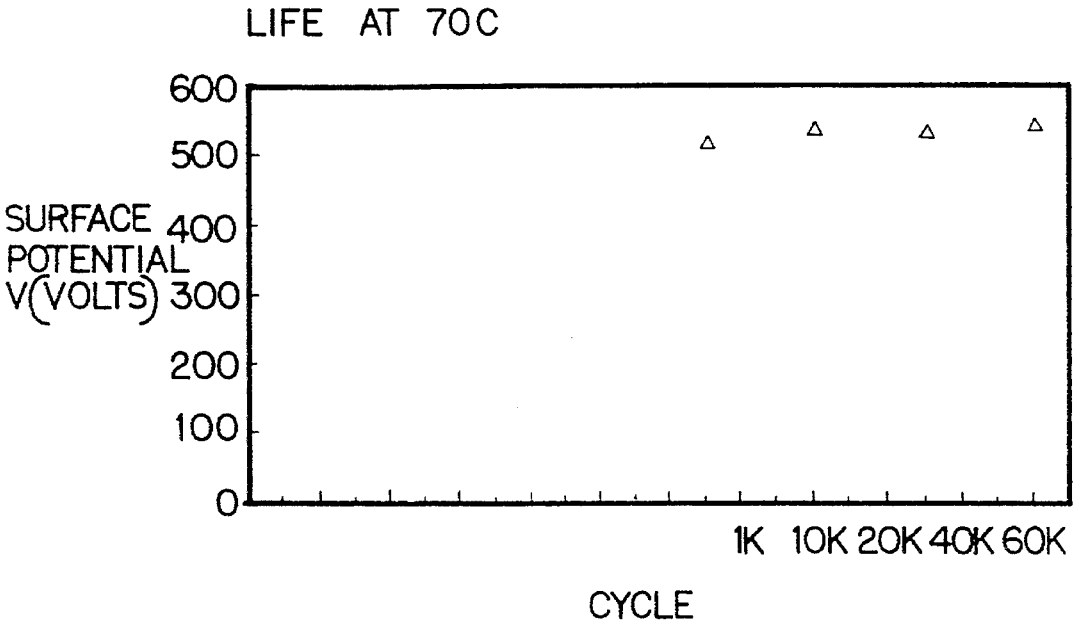

The top coat solution described in EXAMPLE 3, was used to coat the top of the OPC formulated in EXAMPLE 6, by the same coating procedure as in EXAMPLE 3. This four-layer OPC exhibited an excellent life at 70° C. exceeding 60,000 cycles as indicated in FIG. 12.

EXAMPLE 8

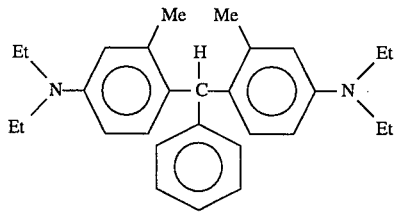

(44)

and 6 g of polycarbonate (Makrolon™) were dissolved in 90 g of dichloromethane (DCM). The solution was coated on an aluminum/mylar substrate using a doctor blade so that the coating thickness became about 15 μm after being dried at 100° C. for 2 hrs. This coating layer performs as a charge transport layer (CTL).

Next, 3 g of x—$H_2Pc$, 27 g of hole transport molecule (44) above described, 70 g of polycarbonate (Makrolon™), and 500 g of dichloromethane (DCM) were milled together using a ball milling procedure with 5 mm ceramic balls as milling media. The milling time was 40 hrs. The solution, after milling, was coated on the top of the charge transport layer above-mentioned, using a doctor blade to achieve a thickness of 6 μm after being dried at 130° C. for 2 hrs. This layer performs as a charge generation layer (CGL).

EXAMPLE 9

Preparation of a Barrier Protection Layer for the Multi-layer Photoconductor of Example 8

First, the electron withdrawing layer described in Example 5 was overcoated on the top of the multi-layer photoconductor of Example 8.

Second, the charge injecting prohibitor layer was overcoated on the electron withdrawing layer, using the same manner described in Example 6.

Figure 13:
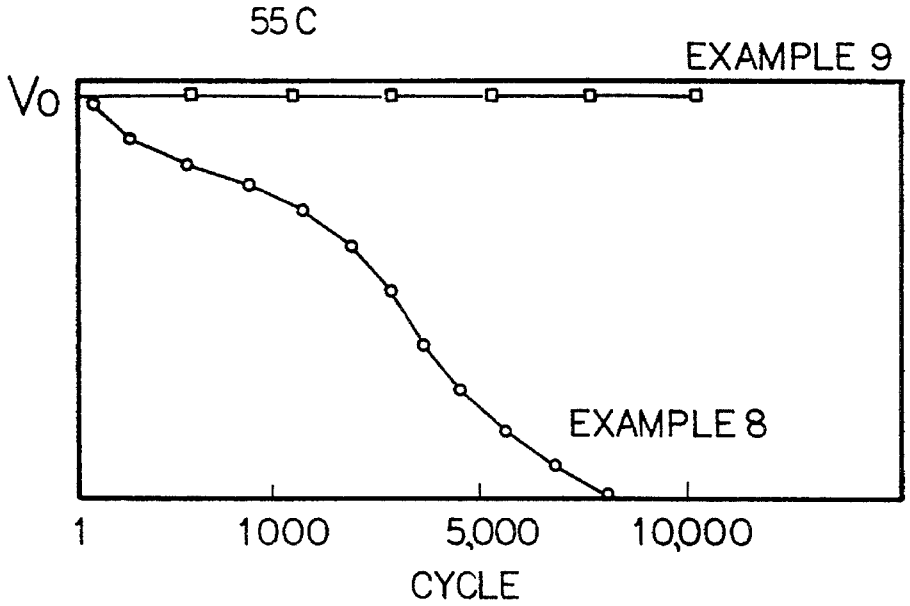

Finally, the top coat solution described in Example 3 was coated on the top of the charge injecting prohibitor layer, using the same procedure described in Example 3. For comparison, the life test results of Example 8 (bare photoconductor) and of Example 9 (protection layer photoconductor) are illustrated in FIG. 13.

EXAMPLE 10

Preparation of a Multilayer Positive Charging (+) Photoconductor II 3 g of x—$H_2P_c$ pigment, 1.5 g of polyester (Vylon 200™ Toyobo) and 100 g of dichloromethane (DCM) were milled together using 5 mm ceramic beads as milling media, in a ceramic pot and on a roll miller. The system was milled for 48 hrs.

The solution was coated on Al/Mylar flexible substrate using a doctor blade to achieve a thickness of 0.1 μm after being dried at 100° C. for 40 minutes. This forms a charge generation layer (CGL).

Next, 4 g of an electron transport molecule (45)

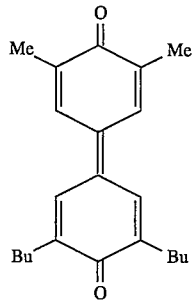

(45)

prepared by a method described in *J. Org. Chem.*, 50, 3297 (1985), by F. Menger and D. Carnahan, 6 g of polycarbonate (Lexan™—General Electric) and 90 g of dichloromethane were mixed together by stirring until a completely dissolved solution was achieved. This solution was overcoated on the top of the charge generation layer above mentioned, using a doctor blade so that a thickness of 15 μm was achieved after being dried at 100° C. for 4 hrs.

EXAMPLE 11

Preparation of a Barrier Layer for the Multi Layer Photoconductor of Example 10

The (+) OPC described in Example 10 was overcoated first with a barrier layer (described in Example 6); and second with the top coat of poly dimethyl siloxane (described in Example 3).

Figure 14:
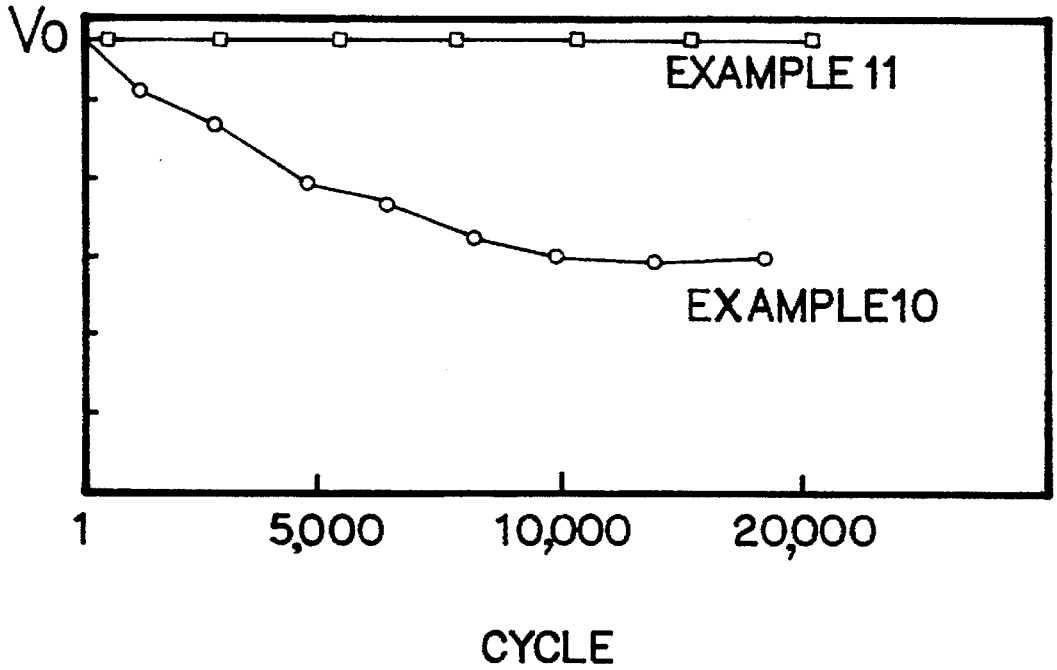

The comparison of results for the bare photoconductor (Example 10) and full construction photoconductor (Example 11) is illustrated in FIG. 14.

While there is shown and described the present preferred embodiment of the invention, it is to be distinctly understood that this invention is not limited thereto but may be variously embodied to practice within the scope of the following claims.

I claim:

1. A barrier layer for a photoconductor used in electrophotography, said barrier layer comprising:

a cross-linking organic binder material comprising polyvinyl alcohol (PVA), and a positive charge injection prohibiting molecule selected from the group consisting of amino compounds having the general formulas:

$$NH_2—R_1—(NR_2)_n—R_3 \quad (9)$$

$$NH_2—A\ (NR_2)_n—R_3 \quad (10)$$

$$NH_2—R_1—(NHR_2)_n—Si(OR_5)_3 \quad (11)$$

$$NH_2—A—Si(OR_5)_3 \quad (12),$$

or from the group of hydroxy or mercapto compounds having the general formulas:

$$HO—R_1—COOR_2 \quad (13)$$

$$HS—R_1—COOR_2 \quad (14)$$

$$R_1—R_2(OH)_n—R_3 \quad (15)$$

$$R_1—R_2(SH)_n—R_3 \quad (16)$$

$$NH_2—R_1(OH)_m—(NR_2)_n—R_3 \quad (17)$$

$$NH_2—A(OH)_m—(NR_2)_n—R_3 \quad (18),$$

where, for formulas 9–18 above:

$R_1$, $R_3$, $R_5$=alkyl, alkoxy, allyl, aryl with and/or without the following substituent groups: —$NO_2$, —CN, —OH, —SH, —$SO_2$, —$SOCl_2$, —S, =C=O, —COOR, —CHO, —Cl, —Br, —I, —F;

$R_2$=hydrogen, alkyl, alkoxyl, aryl with and/or without the following substituent groups —$NO_2$, —CN, —OH, —SH, —SO2, —$SOCl_2$, —S, =C=O, —CHO, —COOR, —Cl, —Br, —I, —F;

A=heterocyclic compounds selected from the following groups;

(19)

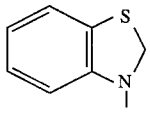

(20)

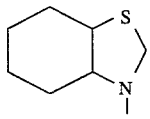

(21)

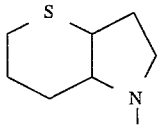

(22)

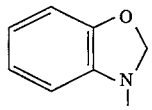

(23)

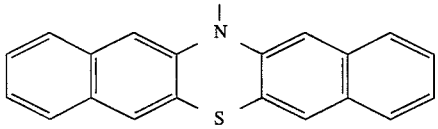

(24)

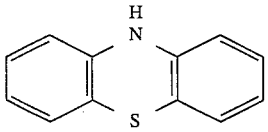

(25)

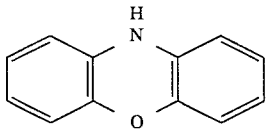

(26)

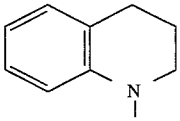

(27)

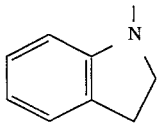

-continued (28)

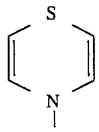

(29)

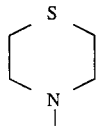

(30)

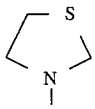

(31)

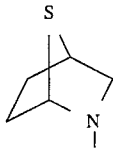

(32)

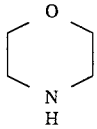

, and m, n=0,1,2 . . . 5.

2. The barrier layer of claim 1 wherein the crosslinked binder comprises polyvinyl alcohol (PVA) and a copolymer of PVA selected from the group consisting of polymethyl methacrylate, polystyrene and fluoro polymer.

3. The barrier layer of claim 1 wherein the positive charge injection prohibiting molecule is:

1,6-Hexamethylene bis (3,5-di-tert-butyl-4-hydroxy)cinnamate;

Tetrakis (methylene (3,5-di-tert-butyl-4-hydroxy hydro) cinnamate) methane:

Thiodiethylene bis (3,5-di-tert-butyl-4-hydroxy hydro) cinnamate; or

Octadecyl 3,5-di-tert-butyl-4-hydroxy hydro cinnamate.

4. The barrier layer of claim 1 wherein the positive charge injection prohibiting molecule is:

Bis(1,2,2,,6,6-pentamethyl-4-piperidinyl) (3,5-di-tert-butyl-4-hydroxybenzyl) butyl propane dioate;

Bis(1,2,2,6,6-penta methyl-4-piperidinyl) sebacate;

2-(2'-Hydroxy-3',5'-di-tert-amyl phenyl) benzotriazole; or

Bis(2,2,6,6-tetramethyl-4-piperidyl) sebacate.

5. The barrier layer of claim 1 wherein the positive charge injection prohibiting molecule is;

Polymerized 1,2-dihydro-2,2,4-trimethyl quinoline.

6. The barrier layer of claim 1 which also comprises an electron withdrawing molecule (EWM) with at least one functional group selected from the group consisting of —C=O, —Cl, —Br, —I, —F, —$NO_2$, —CN, —OH, —$SO_2$, or —COOH.

7. The barrier layer of claim 6 wherein said charge injection prohibiting molecule and said electron withdrawing molecule are in the same molecule, of which the general chemical structure is

A—R—D (43), where A represents the electron withdrawing part of the molecule, selected from the electron withdrawing function groups consisting of: —NO2, —CN, =C=O, —SOx, —S, —OR; wherein R=alkyl, allyl, aryl; X=1, 1.5, 2, 3, 3.5 and 4 and D represents the charge injection prohibiting part of the molecule.

8. The barrier layer of claim 6 wherein said charge injection prohibiting molecule and the electron withdrawing molecule are in the same coating layer.

9. The barrier layer of claim 6 wherein said charge injection prohibiting molecule and the electron withdrawing molecule are in different coating layers.

10. The barrier layer of claim 1 wherein the organic binder material contains a reactive hydroxy containing binder and a reactive anhydride containing binder as a mixture.

11. The barrier layer of claim 1 which also comprises a crosslinker selected from the compounds having the functional groups of dialdehyde, aldehyde, alcohol, or carboxylic anhydride.

12. A barrier layer for a photoconductor used in electrophotography, said barrier layer comprising:

a cross-linking organic binder material comprising polyvinyl butyral (PVB), and a positive charge injection prohibiting molecule selected from the group consisting of amino compounds having the general formulas:

$NH_2—R_1—(NR_2)_n—R_3$ (9)

$NH_2—A\ (NR_2)_n—R_3$ (10)

$NH_2—R_1—(NHR_2)_n—Si(OR_5)_3$ (11)

$NH_2—A—Si(OR_5)_3$ (12), or from the group of hydroxy or mercapto compounds having the general formulas:

$HO—R_1—COOR_2$ (13)

$HS—R_1—COOR_2$ (14)

$R_1—R_2(OH)_n—R_3$ (15)

$R_1—R_2(SH)_n—R_3$ (16)

$NH_2—R_1(OH)_m—(NR_2)_n—R_3$ (17)

$NH_2—A(OH)_m—(NR_2)_n—R_3$ (18), where, for formulas 9–18 above:

$R_1$, $R_3$, $R_5$=alkyl, alkoxy, allyl, aryl with and/or without the following substituent groups: —$NO_2$, —CN, —OH, —SH, —$SO_2$, —$SOCl_2$, —S, =C=O, —COOR, —CHO, —Cl, —Br, —I, —F;

$R_2$=hydrogen, alkyl, alkoxyl, aryl with and/or without the following substituent groups —$NO_2$, —CN, —OH, —SH, —$SO_2$, —SOCl2, —S, =C=O, —CHO, —COOR, —Cl, —Br, —I, —F;

A=heterocyclic compounds selected from the following groups:

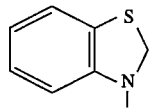
(19)

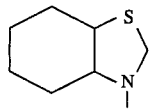
(20)

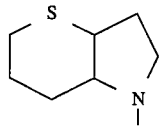
(21)

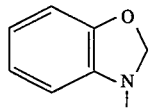
(22)

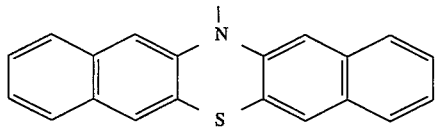
(23)

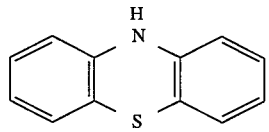
(24)

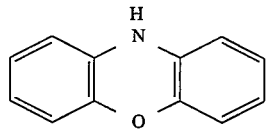
(25)

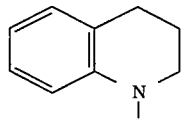
(26)

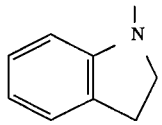
(27)

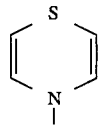
(28)

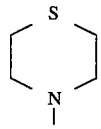
(29)

-continued (30)

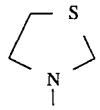

(31)

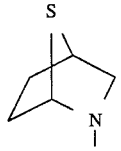

(32)

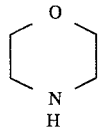

, and m, n=0,1,2 . . . 5.

13. The barrier layer of claim 12 wherein the positive charge injection prohibiting molecule is:

1,6-Hexamethylene bis(3,5-di-tert-butyl-4-hydroxy) cinnamate;

Tetrakis (methylene(3,5-di-tert-butyl-4-hydroxy hydro) cinnamate) methane;

Thiodiethylene bis(3,5-di-tert-butyl-4-hydroxy hydro) cinnamate; or

Octadecyl 3,5-di-tert-butyl-4-hydroxy hydro cinnamate.

14. The barrier layer of claim 12 wherein the positive charge injection prohibiting molecule is:

Bis(1,2,2,6,6-pentamethyl-4-piperidinyl) (3,5-di-tert-butyl-4-hydroxybenzyl) butyl propane dioate;

Bis(1,2,2,6,6-penta methyl-4-piperidinyl) sebacate;

2-(2'-Hydroxy-3',5'-di-tert-amyl phenyl) benzotriazole; or

Bis(2,2,6,6-tetramethyl-4-piperidyl) sebacate.

15. The barrier layer of claim 12 wherein the positive charge injection prohibiting molecule is:

Polymerized 1,2-dihydro-2,2,4-trimethyl quinoline.

16. The barrier layer of claim 12 which also comprises an electron withdrawing molecule (EWM) with at least one functional group selected from the group consisting of —C=O, —Cl, —Br, —I, —F, —$NO_2$, —CN, —OH, —$SO_2$, or —COOH.

17. The barrier layer of claim 16 wherein said charge injection prohibiting molecule and said electron withdrawing molecule are in the same molecule, of which the general chemical structure is

A—R—D (43), where A represents the electron withdrawing part of the molecule, selected from the electron withdrawing function groups consisting of: —$NO_2$, —CN, =C=O, —SOx, —S, —OR; wherein R=alkyl, allyl, aryl; X=1, 1.5, 2, 3, 3.5 and 4 and D represents the charge injection prohibiting part of the molecule.

18. The barrier layer of claim 16 wherein said charge injection prohibiting molecule and the electron withdrawing molecule are in the same coating layer.

19. The barrier layer of claim 16 wherein said charge injection prohibiting molecule and the electron withdrawing molecule are in different coating layers.

20. The barrier layer of claim 12 wherein the organic binder material contains a reactive hydroxy containing binder and a reactive anhydride containing binder as a mixture.

21. The barrier layer of claim 12 which also comprises a crosslinker selected from the compounds having the functional groups of dialdehyde, aldehyde, alcohol, or carboxylic anhydride.

* * * * *